United States Patent [19]

Schallberger

[11] Patent Number: 4,827,894

[45] Date of Patent: May 9, 1989

[54] CROSSBOW

[76] Inventor: Werner Schallberger, Oberhelfenschwilerstr. 171, CH-9126 Necker, Switzerland

[21] Appl. No.: 19,316

[22] PCT Filed: May 30, 1986

[86] PCT No.: PCT/CH86/00073

§ 371 Date: Apr. 1, 1987

§ 102(e) Date: Apr. 1, 1987

[87] PCT Pub. No.: WO86/07135

PCT Pub. Date: Dec. 4, 1986

[30] Foreign Application Priority Data

Jun. 1, 1985 [CH] Switzerland ..... 2321/85

[51] Int. Cl.[4] ..... F41B 5/00

[52] U.S. Cl. ..... 124/25

[58] Field of Search ..... 124/25, 31, 22

[56] References Cited

U.S. PATENT DOCUMENTS

| | | | |
|---|---|---|---|
| 3,509,863 | 5/1970 | Barker | 124/31 |
| 3,670,711 | 6/1972 | Firestone | 124/25 |
| 3,783,852 | 1/1974 | Shepherd | 124/25 |
| 4,388,914 | 6/1983 | Cesin | 124/25 |
| 4,594,994 | 6/1986 | Williams | 124/25 |

*Primary Examiner*—Richard C. Pinkham
*Assistant Examiner*—Gary Jackson
*Attorney, Agent, or Firm*—Edmund M. Jaskiewicz

[57] ABSTRACT

A crossbow, which exhibits a support (2), provided with the arrow guide, and a bow (3) which can be drawn by a string (4), is made ready for shooting by drawing device (19, 22). The drawing device consists of a draw lever (19) rotatably mounted in support (2) of the crossbow and a pusher (22) pivoted on the latter, a pusher which works with shooting slide (14) connected to string (4). On the upper side of support (2) a centrally running longitudinal groove (11, 26) is provided in which drawing device (19, 22) can be inserted in its rest position.

15 Claims, 3 Drawing Sheets

CROSSBOW

Figure 1:
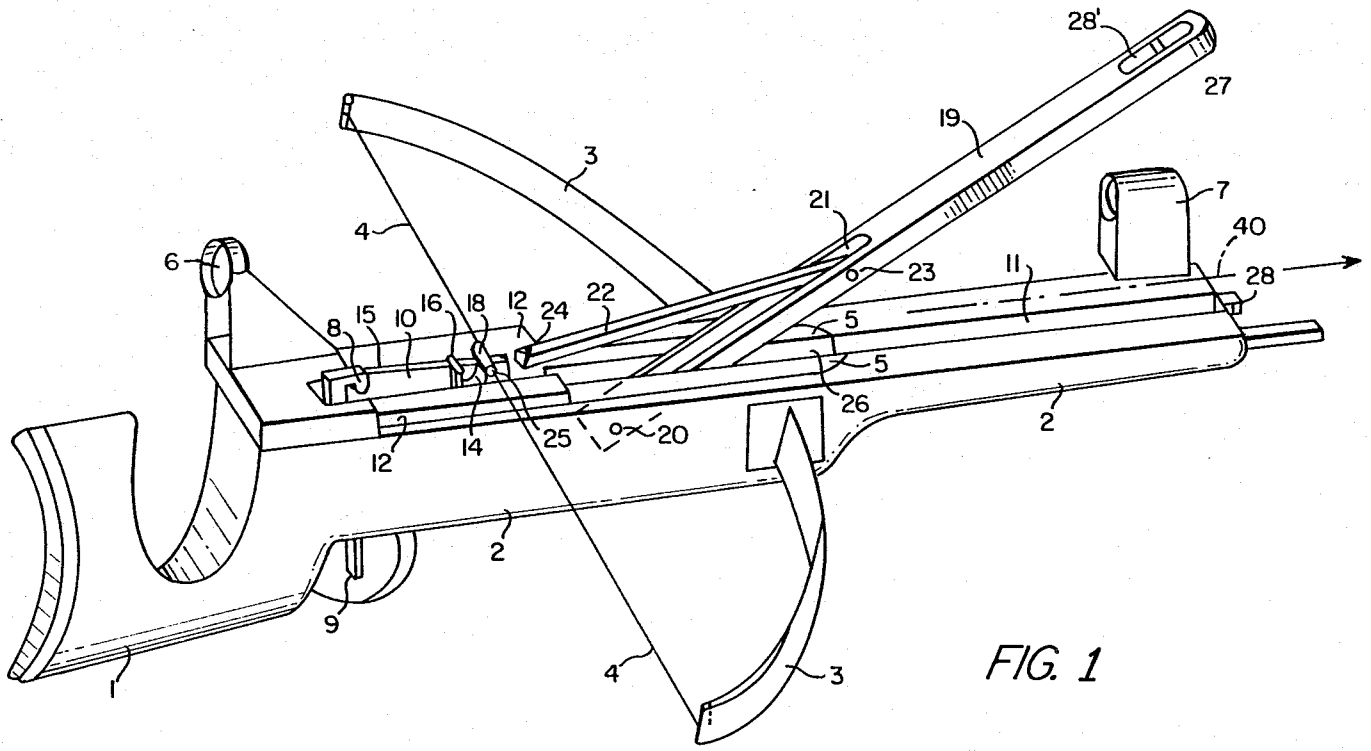

The invention relates to a crossbow consisting of a support adjacent to a shoulder stock, receiving the arrow guide, a support on which is provided a leverlike actuatable drawing device able to act on a string of the bow drawably anchored on the support a string connected to the shooting slide, a drawing device exhibiting a pusher able to move the shooting slide against a trigger device.

Such a crossbow is known, for example, from Swiss Pat. No. 384,409. Drawing of such a heavy-duty crossbow requires considerable force, for which reason specially provided drawing devices are used. Pins projecting in an aligned manner, on which a fork of a drawing device designed leverlike can be placed, are provided, i.a., on both sides of the crossbow. A pusher, pivoted on the yoke of the fork, acts on the shooting slide connected to the string, when the draw lever is actuated, and makes the shooting slide ready for shooting through locking by the trigger device.

Use of this drawing device represents a clumsy manipulablity during operation of this weapon provided for this purpose and does not prove reliable in all cases. Consequently, the constant preparation and storage of such a drawing device is complicated and impairs the shooting operation.

Further, from EP-A-0041206 a crossbow is known in which drawing of the bow can be brought about by three-part lever system provided above the support and arrow guide.

By means of a pusher engaging on pins of the shooting slide projecting laterally from the slide guide the shooting slide can be pushed all the way to the trigger device and be engaged. The shot in a bore, i.e., accelerated from a path is not hindered during shooting by the drawing device, but the bulkiness of the lever system used here too requires a removal of the drawing device from the crossbow. Moreover, with the alternately possible shooting of arrows from a groove on the upper side of a guide a hindrance by the drawing device is hardly avoidable.

In a crossbow according to published prior art Swiss Pat. Nos. 43,791 and 44,542 a drawing device is provided, which exhibits a drawing bow placed on the underside of the support of the crossbow actuatable by a rotating movement, a bow that is rotatably connected to a pusher that can move the shooting slide into shooting position. This drawing device can not be sunk into the support of the crossbow and can be attached only on the underside of the weapon. The necessary large spatial requirement for the drawing mechanism weakens the stability of the support of the crossbow or imposes a larger support cross section and as a result impairs the accuracy of the weapon.

FR-A-2,373,772 calls attention to a crossbow, whose support and stock are connected rotatably on the under side around a horizontal axis. The drawing of the bow occurs by a downwardly directed movement of the stock or support, whereby on the front upper end on both sides of the stock drawing rods are provided which exhibit a driving pin that can be connected to the shooting slide during drawing of the bow.

Because of its relatively short lever arm, this leverlike actuation device requires great effort in the drawing process. Because of the rotatability between stock and support, the stability of the crossbow affecting the shooting accuracy is unfavorably affected.

A crossbow made according to U.S. No. 3,670,711 has a drawing device, in which the draw lever is placed rotatably on the underside on the front end of the stock and exhibits withdrawal rods, running on each side of the support, connecting the shooting slide with the draw lever.

This drawing device, fastened outside the crossbow, because of the additional weight, especially during preparing to shoot, produces a load excessively tiring to the marksman.

Starting from the above criticized insufficiencies and the designs of the prior art badly in need of improvement, the inventor has had the object of providing a crossbow according to the initially described type with a drawing device, which forms an integral component of the crossbow, makes possible a faster draw of the bow and, after the drawing process, can be so placed that the arrow is not hindered by it on its path, does not disturb handling of the crossbow and can be housed in the crossbow as inconspicuously as possible.

The object is attained by the fact that in the rest position of the drawing device the draw lever mounted to be rotatable around the horizontal axis placed perpendicular to the longitudinal extension of the support and the pusher pivoted on the lateral end on the draw lever in the shooting direction ahead of its swivel axis are designed to be sinkable under the arrow shooting path on support.

This drawing device offers a guarantee for a reliable shooting operation and is distinguished by a pleasant mode of operation and a simple design.

A solution is especially advantageous if the draw lever end resting on the support is designed in the shape of a fork, so that the draw lever can be mounted on pins projecting laterally from the support or within the support, whereby in the rest position it could also extend lying laterally on the support.

Alternatively, the support could exhibit a longitudinal groove receiving the draw lever, running approximately centrally, whereby then the support, in case of an outwardly supporting draw lever fork, is provided with recesses for penetration of the latter.

It has proved to be particularly favorable, if the end of the pusher opposite the end acting on the shooting slide is pivoted in a recess on the draw lever extending lengthwise from its swivel support side end so that, with the drawing device inserted, the draw lever and the pusher are placed at least approximately parallel to the arrow shooting path, as a result of which in a simple way a plain drawing device with slight space requirements in the rest position is attained.

It proves to be advantageous if the distance between the pivoting axis of the pusher on the draw lever and the swivel axis of the draw lever is at least half of the distance of the shooting slide, connected to the string, from the trigger device, which allows a favorable design of the lever conditions.

Protecting the drawing device from an unforeseen lifting of the draw lever from the longitudinal groove is brought about by the front end of the support being provided with a stop acting on the sunken draw lever.

The invention then is explained with an embodiment represented in the drawing.

Figure 2:
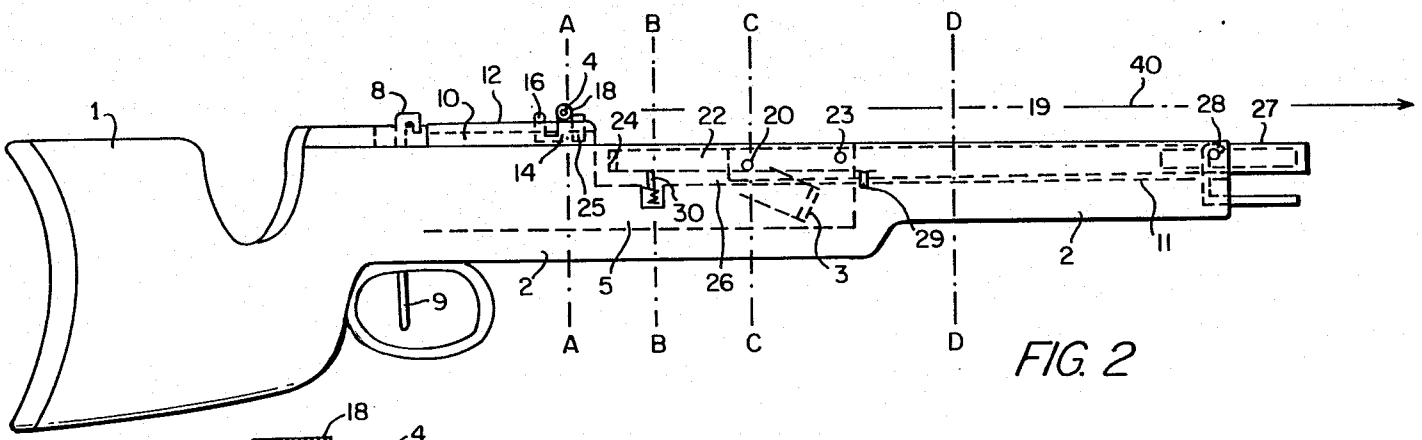
Figure 3:
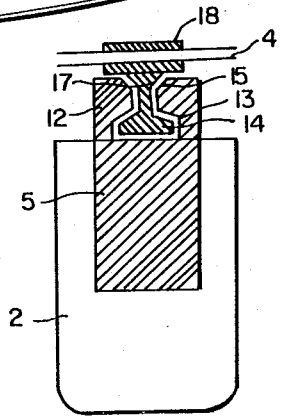
Figure 4:
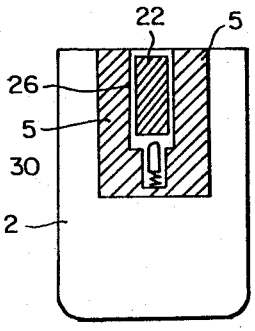
Figure 5:
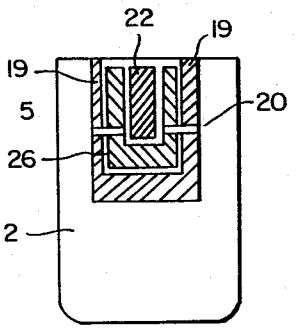
Figure 6:
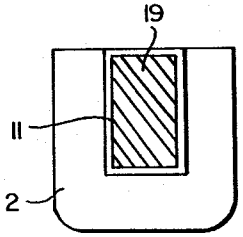

There are shown in:

FIG. 1, a perspective representation of the crossbow with unlocked draw lever,

FIG. 2, a side view of the crossbow in rest position,

FIG. 3, a vertical section along plane A—A in FIG. 2,

FIG. 4, a vertical section along plane B—B in FIG. 2,

FIG. 5, a vertical section along plane C—C in FIG. 2,

FIG. 6, a vertical section along plane D—D in FIG. 2, and

Figure 7:
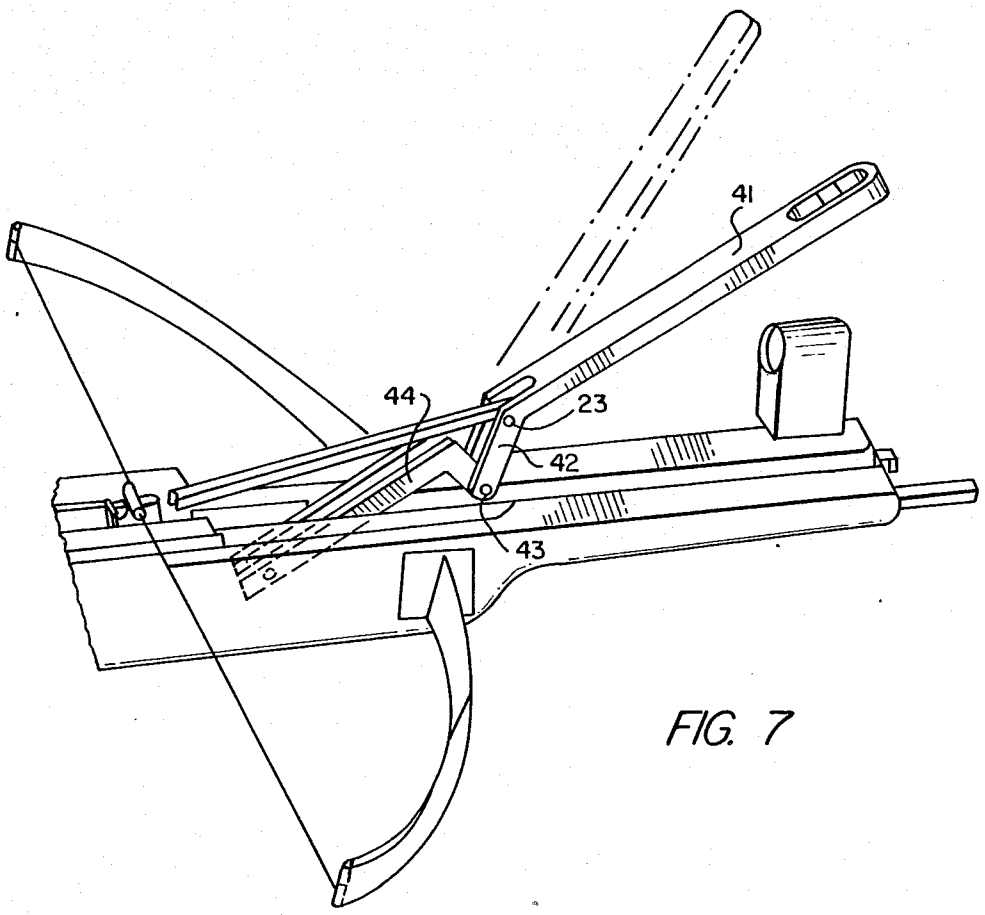

FIG. 7, an alternate embodiment of the drawing device in perspective representation.

The crossbow, represented in the figures in various views and sections, consists of a stock 1 and a support 2, which supports a bow 3, which on its ends is drawn by a string 4. A metal insert 5, which comprises the bow anchoring and axis 20, is embedded in wooden support 2 for reasons of strength and accuracy. Rear sight 6 and front sight 7 of a sighting device are fastened, somewhat laterally offset, on the rear and front part of support 2, and on the back end is placed a trigger device consisting of a trip latch 8 and a trigger 9. Metal insert 5 exhibits over its entire length a slot 10, which continues over the entire length of the front support as adjacent longitudinal groove 11. Further, the rear part of insert 5 exhibits lateral sight mounts 12, which project beyond support 2 and form a sliding space 13 for a trigger slide 14, which is connected to string 4. The inside upper edges of sight mounts 12 are tapered and form a wedged-shaped guide 15 for projectile or arrow, which after tripping of trigger slide 14 from trip latch 8 is shot on an accurate trajectory. For this purpose the back end of the trigger slide is provided with a retainer 16, which engages trip latch 8, and on the upper side of trigger slide 14 is provided with a prolongation 17 projecting from slot 10, a prolongation which supports a holder 18 for string 4. The string is held in such a position because the driving force acting during shooting acts on the center of the projectile or arrow.

For drawing of bow 3 a quick drawing device is provided which consists of a lever system with two elements, namely a draw lever 19, which in support 2 is placed rotatably around an axis 20 that is crosswise to it, and a pusher 22. In this case, axis 20 is in the front part of slot 10 of metal insert 5 between bow 3 and the rest point of string 4. In the lower part draw lever 19 is provided with a longitudinally extending recess 21, into which a pusher 22 of lesser thickness engages and is hinged at a point of rotation 23 at a certain distance from axis 20. Recess 21 is so dimensioned that it can completely receive pusher 22 in the inserted position of the drawing device, except for its free end. This free end exhibits an indentation 24, which in the drawing operation can engage a complementary or positively formed projection 25 of trigger slide 14. With a movement of draw lever 19 from the rest position toward the back end of the crossbow trigger slide 14 is pressed back until it engages holder 18 of the trigger device. To be able to guarantee a flawless functioning, the distance of axis 20 from point of rotation 23 must be a little more than half the draw travel of trigger slide 14 or string 4.

To be able, after the drawing operation, to house the drawing device inconspicuously and without hindering the shooting operation, metal insert 5 and the adjacent front part of support 2 in continuation of slot 10 for the slide movement are provided with corresponding longitudinal groove sections 11, 26, which are so dimensioned that the drawing device when folded back into the extended (rest) position, together with pusher 22 in recess 21 of draw lever 19, is completely received by support 2 or optionally can project without being a hindrance. So that the movement of trigger slide 14 will not be hindered during recoil, adjacent longitudinal groove section 11 exhibits a greater depth than slot 10 for guiding of the slide, so that pusher 22 in folded back condition comes to be completely under trigger slide 14 and a collision during shooting is avoided.

To avoid an automatic release of the drawing device from the rest position it is suitable to lock draw lever 19 in support 2, e.g., by a latch 28 provided on the front end of support 2, which engages in a notch 28 on the front end of draw lever 19. By a stop 29 in longitudinal groove 26 it can be guaranteed that pusher 22 will be pressed totally under slide guide 10. On the other hand, in the back part of deeper longitudinal groove 26 can be provided an elastic support element 30 acting in the opposite direction, which at the beginning of the drawing operation lifts the free end of pusher 22 so far that without difficulty it engages projection 25 of trigger slide 14. Lifting of pusher 22 in this case can also be facilitated by tapering of the trigger slide on the front side and of the pusher on the underside of the front end.

Alternatively, for example, draw lever 19, instead of being provided on the upper side with a recess for receiving pusher 22, can also exhibit a through slot and thus be designed like a fork, which, together with the pusher, can be lowered into support 2. On the other hand, draw lever 19 can also be made as a solid rod, to which also solidly made pusher 22 is laterally hinged. Here too longitudinal groove 26 is so dimensioned in support 2 that it can house the parts of the drawing device.

In any case, with the described drawing devices a crossbow can be drawn especially fast and very simply. In particular it is advantageous that the crossbow can be drawn by a backward pulling movement, i.e., with the drawing it remains in use position and can be supported on the body by the stock, and that the drawing device by a simple folding back can be brought into an inconspicuous, undisturbing rest position. Handling of the crossbow and drawing device is thus made considerably easier.

In a more advantageous development of the invention, with retention of the basic structure of the lever system so far described and illustrated, draw lever 19 can be divided approximately in the area of its point of rotation 23. Especially in this case first lever arm 41 of draw lever 19 is bent in the area of point of rotation 23 and second lever arm 44 also bent, is connected, mutually pivotable, to first lever arm 41 by an axis 43 placed perpendicular to the two lever arms 41, 44 so that such a divided draw lever 19 acts essentially at the site of axis 43 as a constantly bendable lever, longitudinally variable in its effective length, as a result of which by it use the minimal basic structure of a two-lever system 19, 22 is maintained. Since first lever arm 41 is designed as a countersupport of other lever arm 44, the longitudinally variable draw lever, thus divided, with drawing of the crossbow from a presettable swiveling around axis 20, by said countersupport becoming active, moreover exhibits, the rigid structure of a onepiece lever, but with the further advantage that with drawing of the crossbow by a variable action of force an easier and at the same time a faster drawing is achieved.

To maintain a favorable weight of the crossbow with integrated fast drawing device the unit—formed in the represented example from stock 1 and support 2—carrying almost all crossbow parts, consists of at least one nometallic material such as wood or plastic. The parts between bow 3 and axis 20 working together in frictional connection are placed in a mechanically heavy-duty metal insert 5 of said unit to be able to put the crossbow under intense stress, with the smallest possible overall weight. To assure a high capacity of the object of the invention to withstand stress while simultaneously maintaining accuracy, it is particularly advantageous if the system carrying the integrated fast drawing device, consisting of stock 1 and support 2, is produced only from one material, for example, a composite material, of different components, or also from a metal.

The crossbow according to the invention exhibits, with the comprehensive integration of the fast drawing device, the spatial shape of a crossbow apparently without drawing device.

In a word, the invention is distinguished by a simple and reliable cooperation of the necessary parts with a small number of parts for the integrated fast drawing device.

What is claimed is:

1. A crossbow comprising a support (2) having a shoulder stock (1) at one end thereof and another end defining a front end, a bow (3) mounted on said support (2) and having a bow string (4), a shooting slide (14) slideably mounted on said support (2) and attached to said bow string (4), a trigger mechanism in said support adjacent said shoulder stock end and having means (8) engageable with said shooting slide for retaining said shooting slide in a cocked position, means (15) on said support adjacent said trigger mechanism for defining an arrow guide, a draw lever (19) having a first end pivotably mounted on said support to pivot about a horizontal axis (20) transverse to the longitudinal axis of said support and a second end disposed at said front end of said support in a rest position, a pusher member (22) having a first end pivotably connected to said draw lever and having a second end extending away from said front end of said support and engageable with said shooting slide, said support having means therein below a path of an arrow from said arrow guide for receiving said draw lever and pusher member whereby said draw lever and pusher member are recessed within said support below said path of an arrow when in the rest position.

2. Crossbow according to claim 1, wherein the draw lever end, resting on support (2), is designed in the shape of a fork.

3. Crossbow according to claim 1 wherein said receiving means comprises a longitudinal groove (11, 26), in said support running approximately centrally, at least partially receiving said draw lever (19).

4. Crossbow according to claim 3 wherein pusher member (22) is provided with an extension projecting beyond pivoting axis (23), said extension which, with draw lever (19) inserted, engages a stop (29) in said longitudinal groove (11, 26) to limit pivoting movement of pusher member (22).

5. Crossbow according to claim 4, and further comprising a resilient support element (30) in said longitudinal groove (11, 26) in the shooting direction behind pivoting axis (23) of pusher member (22), to raise said pusher with the second end from the stop, when draw lever (19) is released, to the level of shooting slide (14).

6. Crossbow according to claim 1, wherein the end of pusher member (22) opposite end (41) acting on shooting slide (14) is pivoted in a recess (21) on draw lever (19) extending lengthwise from its swivel support side end so that, with drawing device (19, 22) inserted, draw lever (19) and pusher member (22) are placed at least approximately parallel to the arrow shooting path.

7. Crossbow according to claim 1 wherein the distance between pivoting axis (23) of pusher member (22) on draw lever (19) and swivel axis (20) of draw lever (19) is at least half of the distance of shooting slide (14), connected to string (4), from trigger device (8).

8. Crossbow according to claim 1 wherein the front end of support (2) comprises a locking device (28) acting on recessed draw lever (19).

9. Crossbow according to claim 1 and means on said support for defining the movement path of the shooting slide (14).

10. Crossbow according to claim 9, wherein the movement path of shooting slide (14) is disposed under arrow guide (15).

11. Crossbow according to claim 1 wherein said second end (24) of pusher member (22) and front end (25) of shooting slide (14) are shaped complementary to one another.

12. Crossbow according to claim 1 wherein the draw lever is formed from at least two lever arms (41, 44) connected by a link, in which first lever arm (41), exhibiting the free end of the draw lever, and second lever arm (44) resting on swivel axis (20) of the draw lever are bent before their common axis (43) for connecting to support (2).

13. Crossbow according to claim 12, wherein pusher member (22) is connected to first lever arm (41).

14. Crossbow according to claim 1 wherein support (2) has a nonmetallic shaft.

15. Crossbow according to claim 1 wherein stock (1) and support (2) are constructed as one piece.

* * * * *